US011455959B2

(12) United States Patent
Park et al.

(10) Patent No.: US 11,455,959 B2
(45) Date of Patent: Sep. 27, 2022

(54) DISPLAY DEVICE

(71) Applicant: Samsung Display Co., Ltd., Yongin-Si (KR)

(72) Inventors: Gyung Soon Park, Seoul (KR); Min Kyu Woo, Seoul (KR); Jun Ki Jeong, Anyang-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 9 days.

(21) Appl. No.: 16/703,968

(22) Filed: Dec. 5, 2019

(65) Prior Publication Data

US 2020/0193917 A1 Jun. 18, 2020

(30) Foreign Application Priority Data

Dec. 18, 2018 (KR) ..... 10-2018-0164052

(51) Int. Cl.
*G09G 3/3266* (2016.01)
*G09G 3/3291* (2016.01)

(52) U.S. Cl.
CPC ..... *G09G 3/3291* (2013.01); *G09G 3/3266* (2013.01)

(58) Field of Classification Search
CPC ..... H01L 27/3276; H01L 27/1222; H01L 27/3258; H01L 27/124; H01L 27/3248;
(Continued)

(56) References Cited

U.S. PATENT DOCUMENTS 9,865,667 B2 1/2018 Gil et al.
10,431,599 B2 10/2019 Lee et al.
(Continued)

FOREIGN PATENT DOCUMENTS

KR 10-2016-0114219 10/2016
KR 10-2018-0030363 3/2018
(Continued)

*Primary Examiner* — Temesghen Ghebretinsae
*Assistant Examiner* — Karin Kiyabu
(74) *Attorney, Agent, or Firm* — H.C. Park & Associates, PLC

(57) ABSTRACT

A display device according to an exemplary embodiment of the invention includes: a substrate; an active pattern including a semiconductor material disposed on the substrate; a first conductive layer disposed on the active pattern, the first conductive layer including a plurality of scan lines and a driving gate electrode; a second conductive layer disposed on the first conductive layer, the second conductive layer including an initialization voltage line to transmit an initialization voltage; a third conductive layer disposed on the second conductive layer, the third conductive layer including a driving voltage line to transmit a driving voltage; a fourth conductive layer disposed on the third conductive layer, the first conductive layer including a first data line that transmits a data signal; and a pixel electrode layer disposed on the fourth conductive layer, the pixel electrode layer including a plurality of pixel electrodes, wherein the third conductive layer includes a connection member that is electrically connected with the initialization voltage line, and the first data line includes a projecting portion that extends in a direction away from the connection member.

13 Claims, 11 Drawing Sheets

(58) Field of Classification Search
CPC .... H01L 51/52; G09G 3/3291; G09G 3/3266; G09G 2320/0214; G09G 2320/0242; G09G 2300/043; G09G 2300/0404; G09G 3/3258; G09G 3/32; G09G 3/3225; G09G 3/3208
See application file for complete search history.

(56) References Cited

U.S. PATENT DOCUMENTS

| | | | | |
|---|---|---|---|---|
| 2009/0243470 | A1* | 10/2009 | Chu | H01L 27/3248 313/504 |
| 2016/0217743 | A1* | 7/2016 | Kim | H01L 27/3276 |
| 2016/0254340 | A1* | 9/2016 | Kwon | H01L 27/3276 257/40 |
| 2016/0284267 | A1* | 9/2016 | Gil | H01L 27/3265 |
| 2017/0077207 | A1* | 3/2017 | Kim | H01L 27/3265 |
| 2018/0076273 | A1 | 3/2018 | Kim et al. | |
| 2018/0151654 | A1 | 5/2018 | Lee | |

FOREIGN PATENT DOCUMENTS

| | | |
|---|---|---|
| KR | 10-2018-0061723 | 6/2018 |
| KR | 10-2018-0076661 | 7/2018 |

* cited by examiner

DISPLAY DEVICE

CROSS-REFERENCE TO RELATED APPLICATION

This application claims priority from and the benefit of Korean Patent Application No. 10-2018-0164052, filed on Dec. 18, 2018, which is hereby incorporated by reference for all purposes as if fully set forth herein.

BACKGROUND

Field

Exemplary implementations of the invention relate generally to a display device and, more specifically, to display device for reducing interference in display devices caused by the close spacing signal lines, such as data and power lines.

Discussion of the Background

The display device includes a plurality of pixels, which are units for displaying an image. Specifically, a pixel of a display device that includes an emission layer may include a light emission diode including a cathode, an anode, and an emission layer, a plurality of transistors for driving the light emission diode, and at least one capacitor.

The light emission diode includes two electrodes and an emission layer disposed between the two electrodes. Electrons injected from a cathode, which is one of the two electrodes, and holes injected from an anode, which is the other electrode, are coupled to each other in the emission layer to form an exciton, and the exciton may emit light while emitting energy.

The plurality of transistors include a least one switching transistor and a driving transistor. The switching transistor receives a data signal according to a scan signal and transmits a voltage according to the data signal to the driving transistor, and the driving transistor controls the amount of driving current transmitted to the light emission diode by being directly or indirectly connected to the light emission diode such that each pixel can emit light of desired luminance.

The capacitor is connected to a driving gate electrode of the driving transistor to maintain a voltage of the driving gate electrode.

Demand by consumers for smaller and higher quality devices have resulted in manufacturers building display devices that have reduced size and/or increased resolution, which requires an increased number of pixels in reduced spaced. Consequently the signal lines in the display must be spaced together more closely, which can result in noise, data coupling and other types of interference that can adversely affect the performance of the display.

The above information disclosed in this Background section is only for understanding of the background of the inventive concepts, and, therefore, it may contain information that does not constitute prior art.

SUMMARY

Display devices constructed according to the principles and exemplary implementations of the invention are capable of improving display quality by reducing interference between signal lines, such as generation of stains due to coupling of data signals.

For example, if a data line is disposed close to a power line or member carrying the initialization voltage, coupling between a data signal and an initialization voltage may occur when a data voltage is charged or changed in the data line, or a ripple may occur in the initialization voltage due to the parasitic capacitor formed between the data line and power line. The changed (i.e., rippled) initialization voltage transmitted by the initialization voltage line may cause a data voltage charged in an adjacent data line to be changed, thereby causing a display failure. However, according to the principles and exemplary embodiments of the invention, the data lines may have one or more projecting portions that are formed (such as bent) away from the power line or member that delivers the initialization voltage such that the parasitic capacitance can be reduced and coupling between the initialization voltage and the data signal can be prevented, thereby preventing a display failure such as horizontal line stains.

According to other principles and exemplary embodiments of the invention, a shield member may be disposed vertically between the power line or member that delivers the initialization voltage and the data line(s). The shield member shields the data line(s) and the active pattern. Thus, coupling between the data signal delivered by the data line(s) the initialization voltage can be prevented. The shield member may be used in lieu of or in conjunction with bent portions of the data lines.

Additional features of the inventive concepts will be set forth in the description which follows, and in part will be apparent from the description, or may be learned by practice of the inventive concepts.

According to one aspect of the invention, a display device includes: a substrate; an active pattern including a semiconductor disposed on the substrate; a first conductive layer disposed on the active pattern, the first conductive layer including a plurality of scan lines and a driving gate electrode; a second conductive layer disposed on the first conductive layer, the second conductive layer including an initialization voltage line to transmit an initialization voltage; a third conductive layer disposed on the second conductive layer, the third conductive layer including a driving voltage line to transmit a driving voltage; a fourth conductive layer disposed on the third conductive layer, the fourth conductive layer including a first data line to transmit a data signal; and a pixel electrode layer disposed on the fourth conductive layer, the pixel electrode layer including a plurality of pixel electrodes, wherein the third conductive layer includes a connection member electrically connected with the initialization voltage line, and the first data line includes a projecting portion that extends in a direction away from the connection member.

The display device may further include: a first insulation layer disposed between the active pattern and the first conductive layer; a second insulation layer disposed between the first conductive layer and the second conductive layer; a third insulation layer disposed between the second conductive layer and the third conductive layer; and a fourth insulation layer disposed between the third conductive layer and the fourth conductive layer, wherein the third insulation layer may have a first contact hole extending through the initialization voltage line, the first insulation layer, the second insulation layer, and the third insulation layer may have a second contact hole extending through a first conductive region of the active pattern, and the connection member may be electrically connected with the initialization voltage line through the first contact hole, and may be electrically connected with the first conductive region of the active pattern through the second contact hole.

The connection member may include a portion that extends substantially in parallel with the first data line.

The display device may further include a second data line that neighbors the first data line in a first direction, a third data line that neighbors the second data line in the first direction, and a fourth data line that neighbors the third data line in the first direction, the fourth data line and the first data line may have shapes that are substantially symmetrical to each other in the first direction, and the third data line and the second data line may have shapes that are substantially symmetrical to each other in the first direction.

The first data line may intersect the initialization voltage line, and the active pattern may include a portion disposed between the first data line and the initialization voltage line.

The second data line may intersect the initialization voltage line, and the driving voltage line may include a portion disposed between the second data line and the initialization voltage line.

The active pattern may further include a second conductive region connected with the first conductive region, the second conductive region may be disposed between the first data line and the connection member, and the second conductive layer may further include a conductive pattern that overlaps the second conductive region.

The conductive pattern may be electrically connected with the driving voltage line.

The plurality of scan lines may include a first scan line and a second scan line, and the conductive pattern may be disposed between the first scan line and the second scan line.

The pixel electrode layer may further include a plurality of first voltage lines to transmit the driving voltage, the plurality of first voltage lines may be arranged in one direction in a display area where the plurality of pixel electrodes are disposed, and the plurality of first voltage lines may extend to an outer area of the display area and may be connected with a wire configured to transmit the driving voltage.

The plurality of first voltage lines may not be electrically coupled with the driving voltage line in the display area.

The projecting portion of the first voltage line may include a bent portion bent along a periphery of the plurality of pixel electrodes.

The display device may further include a common electrode disposed on the plurality of pixel electrodes to receive a common voltage, wherein the pixel electrode layer may further include a plurality of first voltage lines to transmit the common voltage, the plurality of first voltage lines may be arranged in one direction in a display area where the plurality of pixel electrodes are disposed, and the plurality of first voltage lines may extend to an outer area of the display area and may be connected with a wire to transmit the common voltage.

According to another aspect of the invention, a display device includes: a substrate; an active pattern including a semiconductor material disposed on the substrate; a first conductive layer disposed on the active pattern, the first conductive layer including a plurality of scan lines and a driving gate electrode; a second conductive layer disposed on the first conductive layer, the second conductive layer including an initialization voltage line that transmits an initialization voltage; a third conductive layer disposed on the second conductive layer, the third conductive layer including a driving voltage line that transmits a driving voltage; a fourth conductive layer disposed on the third conductive layer, the fourth conductive layer including a first data line that transmits a data signal; and a pixel electrode layer disposed on the fourth conductive layer, the pixel electrode layer includes a plurality of pixel electrodes, wherein the third conductive layer includes a connection member electrically connected with the initialization voltage line, the active pattern includes a first conductive region vertically disposed between the first data line and the connection member, and the second conductive layer further includes a conductive pattern that overlaps the first conductive region.

The conductive pattern may be electrically connected with the driving voltage line.

The plurality of scan lines may include a first scan line and a second scan line, and the conductive pattern may be disposed between the first scan line and the second scan line.

The active pattern may further include a second conductive region connected to the first conductive region, and the connection member may be electrically connected to the second conductive region.

According to still another aspect of the invention, a display device includes: a substrate; an active pattern including a semiconductor material disposed on the substrate; a first conductive layer disposed on the active pattern, the first conductive layer including a plurality of scan lines and a driving gate electrode; a second conductive layer disposed on the first conductive layer, the second conductive layer including an initialization voltage line that transmits an initialization voltage; a third conductive layer disposed on the second conductive layer, first conductive layer including a driving voltage line that transmits a driving voltage; a fourth conductive layer disposed on the third conductive layer, the fourth conductive layer including a first data line that transmits a data signal; and a pixel electrode layer disposed on the fourth conductive layer, the pixel electrode layer including a plurality of pixel electrodes, wherein the pixel electrode layer may further include a plurality of first voltage lines to transmit the driving voltage, the plurality of first voltage lines are arranged in one direction in a display area where the plurality of pixel electrodes are disposed, and the plurality of first voltage lines are not electrically coupled with the driving voltage line in the display area.

The plurality of first voltage lines may extend to an outer area of the display area and may be connected with a wire to transmit a constant voltage.

The first voltage line may be bent along a periphery of the plurality of pixel electrodes.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
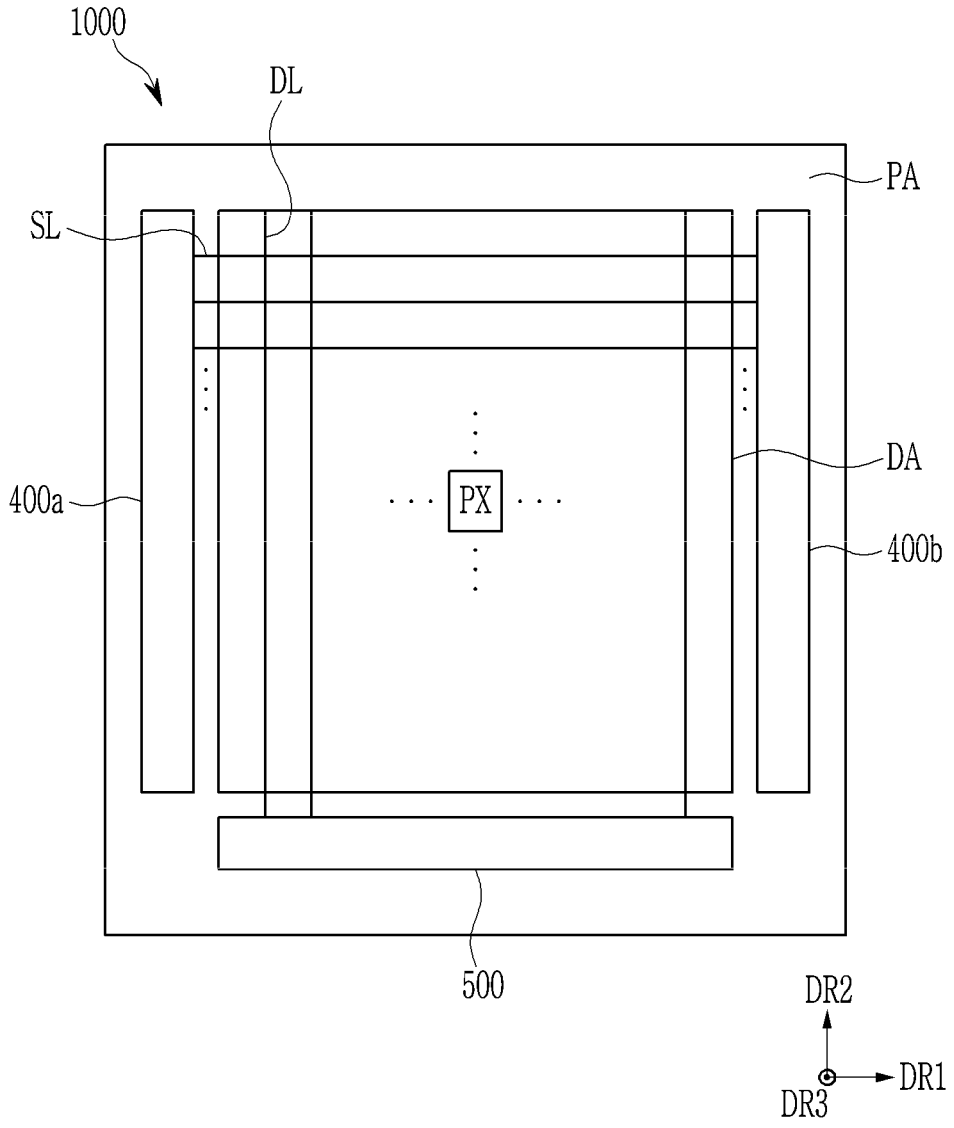
FIG. 1 is a schematic layout view of a display device according to an exemplary embodiment.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Various exemplary embodiments are described herein with reference to sectional and/or exploded illustrations that are schematic illustrations of idealized exemplary embodiments and/or intermediate structures. As such, variations from the shapes of the illustrations as a result, for example, of manufacturing techniques and/or tolerances, are to be expected. Thus, exemplary embodiments disclosed herein should not necessarily be construed as limited to the particular illustrated shapes of regions, but are to include deviations in shapes that result from, for instance, manufacturing. In this manner, regions illustrated in the drawings may be schematic in nature and the shapes of these regions may not reflect actual shapes of regions of a device and, as such, are not necessarily intended to be limiting.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Referring to FIG. 1, a display device according to an exemplary embodiment will be described.

FIG. 1 is a schematic layout view of a display device according to an exemplary embodiment.

A display device 1000 according to an exemplary embodiment may include a display area DA that can display an image, and a peripheral area PA that is disposed at the periphery of the display area DA.

The display area DA may display an image on a plane that is generally parallel with a first direction DR1 and a second direction DR2. The display area DA includes a plurality of pixels PX and a plurality of signal lines.

A pixel PX may be defined as a unit which includes a display circuit for driving an area where light can be emitted with respect to a video signal.

The plurality of signal lines may include a plurality of scan lines SL that can transmit a scan signal, and a plurality of data lines DL that can transmit a data signal.

Each scan line SL extends substantially in the first direction DR1 in the display area DA, and may be connected to scan drivers 400*a* and 400*b* that are disposed in the peripheral area PA.

The data lines DL may extend substantially in the second direction DR2, while crossing the plurality of scan lines SL in the display area DA.

The pixel PX may include at least one switch and a pixel electrode connected to the switch. The switch may be connected to the scan line SL, and is turned on or turned off according to a scan signal transmitted by the scan line SL to selectively transmit a data signal transmitted by the data line DL to the pixel electrode.

The peripheral area PA may include the scan drivers 400*a* and 400*b* and a data driver 500. The scan drivers 400*a* and 400*b* are connected with the scan lines SL and thus may apply a scan signal to the scan lines SL. The scan drivers 400*a* and 400*b* may be formed together with the plurality of signal lines and the switch disposed in the display area DA. FIG. 1 exemplarily illustrates that the scan drivers 400*a* and 400*b* are respectively disposed at the left and right sides with respect to the display area DA, but this is not restrictive. Either one of the scan drivers 400*a* or 400*b* can be omitted.

The data driver 500 may include at least one driving circuit chip, and may apply a data signal to a data line DL by being connected thereto.

Figure 2:
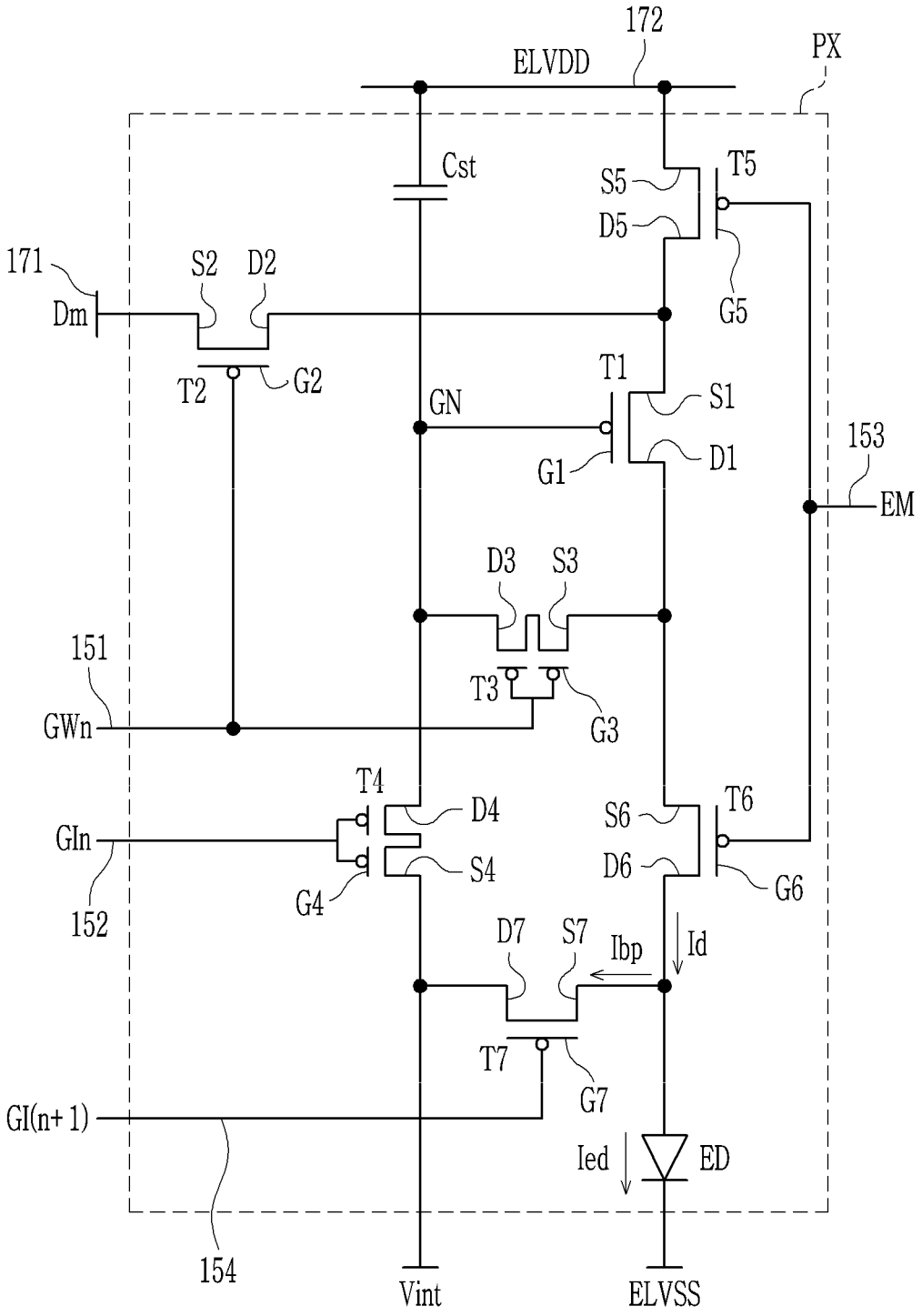
FIG. 2 is a circuit diagram of a representative pixel of the display device of FIG. 1.

FIG. 2 is a circuit diagram of a representative pixel of the display device of FIG. 1.

Referring to FIG. 2, a pixel PX may include a plurality of transistors T1, T2, T3, T4, T5, T6, and T7 connected to a plurality of signal lines 151, 152, 153, 154, 171, and 172, a capacitor Cst, and at least one light emitting diode ED. In the illustrated exemplary embodiment, an example in which one pixel PX includes one light emitting diode ED will be mainly described.

The signal lines 151, 152, 153, 154, 171, and 172 may include a plurality of scan lines 151, 152, and 154, a control line 153, a data line 171, and a driving voltage line 172.

The plurality of scan lines 151, 152, and 154 correspond to the above-described scan lines SL, and may respectively transmit scan signals GWn, GIn, and GI(n+1). The scan signals GWn, GIn, and GI(n+1) may transmit a gate-on voltage and a gate-off voltage that can turn on/turn off the transistors T2, T3, T4, and T7 included in the pixel PX.

The scan lines 151, 152, and 154 connected to one pixel PX may include a first scan line 151 that may transmit the first scan signal GWn, a second scan line 152 that may transmit the second scan signal GIn having the gate-on voltage with different timing than that of the first scan line 151, and a third scan line 154 that may transmit the third scan signal GI(n+1). The second scan line 152 may transmit the gate-on voltage at a timing prior to the first scan line 151. For example, when the first scan signal GWn is an n-th scan signal Sn (n is a natural number equal to or greater than 1) among the scan signals applied during one frame, the second scan signal GIn may be is a previous stage scan signal such as an (n−1)th scan signal S(n−1), and the third scan signal GI(n+1) may be the n-th scan signal Sn. However, the illustrated exemplary embodiment is not limited thereto, and the third scan signal GI(n+1) may be a scan signal other than the n-th scan signal Sn.

The control line 153 may transmit a light emission control signal that can control light emission of the light emitting diode ED. The light emission control signal may transmit a gate-on voltage and a gate-off voltage.

The data line 171 may transmit a data signal Dm, and the driving voltage line 172 may transmit a driving voltage ELVDD. The data signal Dm may have a different voltage level depending on a video image input to the display device, and the driving voltage ELVDD may have a substantially constant level.

The display device may further include a driver that transmits a signal to the plurality of signal lines 151, 152, 153, 154, 171, and 172.

The plurality of transistors T1, T2, T3, T4, T5, T6, and T7 included in one pixel PX may include a first transistor T1, a second transistor T2, a third transistor T3, a fourth transistor T4, a fifth transistor T5, a sixth transistor T6, and a seventh transistor T7.

The first scan line 151 may transmit the first scan signal GWn to the second transistor T2 and the third transistor T3, the second scan line 152 may transmit the second scan signal GIn to the fourth transistor T4, the third scan line 154 may transmit the third scan signal GI(n+1) to the seventh transistor T7, and the control line 153 may transmit the light emission control signal EM to the fifth transistor T5 and the sixth transistor T6.

A gate electrode G2 of the first transistor T1 is connected with one end of the capacitor Cst through a driving gate node GN, a source electrode S1 of the first transistor T2 is connected with a driving voltage line 172 via the fifth transistor T5, and a drain electrode D1 of the first transistor T1 is connected with an anode of the light emitting diode ED via the sixth transistor T6. The first transistor T1 receives the data signal Dm transmitted by the data line 171, and supplies a driving current Id to the light emitting diode ED according to a switching operation of the second transistor T2.

A gate electrode G2 of the second transistor T2 is connected with the first scan line 151, a source electrode S2 of the second transistor T2 is connected with the data line 171, and a drain electrode D2 of the second transistor T2 is connected with the source electrode S1 of the first transistor T2 while being connected with the driving voltage line 172 via the fifth transistor T5. The second transistor T2 may transmit the data signal Dm transmitted from the data line 171 to the source electrode S1 of the first transistor T1 by being turned on according to the first scan signal GWn received through the first scan line 151.

A gate electrode G3 of the third transistor T3 is connected with the first scan line 151, and a source electrode S3 of the third transistor T3 is connected with an anode of the light emitting diode ED via the sixth transistor T6 while being connected with the drain electrode D1 of the first transistor T1. A drain electrode D3 of the third transistor T3 is connected with a drain electrode D4 of the fourth transistor T4, a first end of the capacitor Cst, and the gate electrode G1 of the first transistor T1. The third transistor T3 is turned on according to the first scan signal GWn received through the first scan line 151, and thus may diode-connect the first transistor T1 by connecting the gate electrode G1 and the drain electrode D1 of the first transistor T1 to each other.

The gate electrode G4 of the fourth transistor T4 is connected with the second scan line 152, a source electrode S4 of the fourth transistor T3 is connected with a terminal of an initialization voltage Vint, and a drain electrode D4 of the fourth transistor T4 is connected with the first end of the capacitor Cst and the gate electrode G1 of the first transistor T1 via the drain electrode D3 of the third transistor T3. The fourth transistor T4 is turned on according to the second scan signal GIn received through the second scan line 152, and thus may perform an initialization operation to initialize a voltage of the gate electrode G1 of the first transistor T1 by transmitting the initialization voltage Vint to the gate electrode G1 of the first transistor T1.

A gate electrode G5 of the fifth transistor T5 is connected with the control line 153, a source electrode S5 of the fifth transistor T5 is connected with the driving voltage line 172, and a drain electrode D5 of the fifth transistor T5 is connected with the source electrode S1 of the first transistor T1 and the drain electrode D2 of the second transistor T1.

A gate electrode G6 of the sixth transistor T6 is connected with the control line 153, a source electrode S6 of the sixth transistor T6 is connected with the drain electrode D1 of the first transistor T1 and the source electrode S3 of the third transistor T3, and a drain electrode D6 of the sixth transistor T6 is electrically connected with the anode of the light emitting diode ED. The fifth transistor T5 and the sixth transistor T6 are simultaneously turned on according to the light emission control signal EM received through the control line 153, and thus the driving voltage ELVDD is compensated by the diode-connected first transistor T1 and then transmitted to the light emitting diode ED.

A gate electrode G7 of the seventh transistor T7 is connected with the third scan line 154, a source electrode S7 of the seventh transistor T7 is connected with the drain electrode D6 of the sixth transistor T6 and the anode of the light emitting diode ED, and a drain electrode D7 of the seventh transistor T7 is connected with the terminal of the initialization voltage Vint and the source electrode S4 of the fourth transistor T7.

The transistors T1, T2, T3, T4, T5, T6, and T7 may be provided as P-type channel transistors, but this is not restrictive. At least one of the transistors T1, T2, T3, T4, T5, T6, and T7 may be provided as an N-type channel transistor.

As previously described, the first end of the capacitor Cst is connected with the gate electrode G1 of the first transistor T1, and a second end thereof is connected with the driving voltage line 172. The anode of the light emitting diode ED may be connected with a terminal of a common voltage ELVSS, which transmits the common voltage ELVSS, and thus may receive the common voltage ELVSS.

The structure of the representative pixel PX according to the exemplary embodiment is not limited to the structure shown in FIG. 2, and the number of transistors and the number of capacitors included in one pixel PX, and the connection relationships thereof, can be variously modified.

Next, operation of the display device according to the exemplary embodiment will be briefly described with reference to FIG. 2.

When a second scan signal GIn having a gate-on voltage level is supplied through the second scan line 152 during an initialization period (here, the second scan signal GIn may be an (n−1)th scan signal S(n−1)), the fourth transistor T4 is turned on and thus the initialization voltage Vint is transmitted to the gate electrode G1 of the first transistor T1 through the fourth transistor T4, and the first transistor T1 is initialized by the initialization voltage Vint.

Next, when a first scan signal GWn (here, the first scan signal GWn may be an n-th scan signal Sn) having a gate-on voltage level is applied through the first scan line 151 during a data programming and compensation period, the second transistor T2 and the third transistor T3 are turned on. The first transistor T1 is diode-connected by the turned-on third transistor T3, and is biased in a forward direction. Then, a compensation voltage reduced by a threshold voltage of the first transistor T1 from the data signal Dm supplied through the data line 171 is applied to the gate electrode G1 of the first transistor T1. The driving voltage ELVDD and the compensation voltage are applied to opposite ends of the capacitor Cst, and thus charges that correspond to a difference voltage between the opposite ends of the capacitor Cst may be stored in the capacitor Cst.

Next, when a light emission control signal EM supplied from the control line 153 during the light emission period is changed to the gate-on voltage level from the gate-off voltage level, the fifth transistor T5 and the sixth transistor T6 are turned on, and then a driving current Id according to a voltage difference between a gate voltage of the gate electrode G1 of the first transistor T1 and the driving voltage ELVDD is generated, so that the driving current Id is supplied to the light emitting diode ED through the sixth transistor T6 such that a current led flows to the light emitting diode ED.

During an initialization period, the seventh transistor T7 is turned on by receiving a third scan signal GI(n+1) of a gate-on voltage through the third scan line 154. The third scan signal GI(n+1) may be an n-th scan signal Sn. The turned-on seventh transistor T7 may be partially drawn out through the seventh transistor T7 as a bypass current Ibp.

Hereinafter, a detailed structure of a display device according to an exemplary embodiment will be described with reference to FIG. 3 to FIG. 9, together with the above-described FIG. 2. For convenience of explanation, the stacked layers will be described in the order of layers, and the planar structure will be described in the description of each layer.

Figure 3:
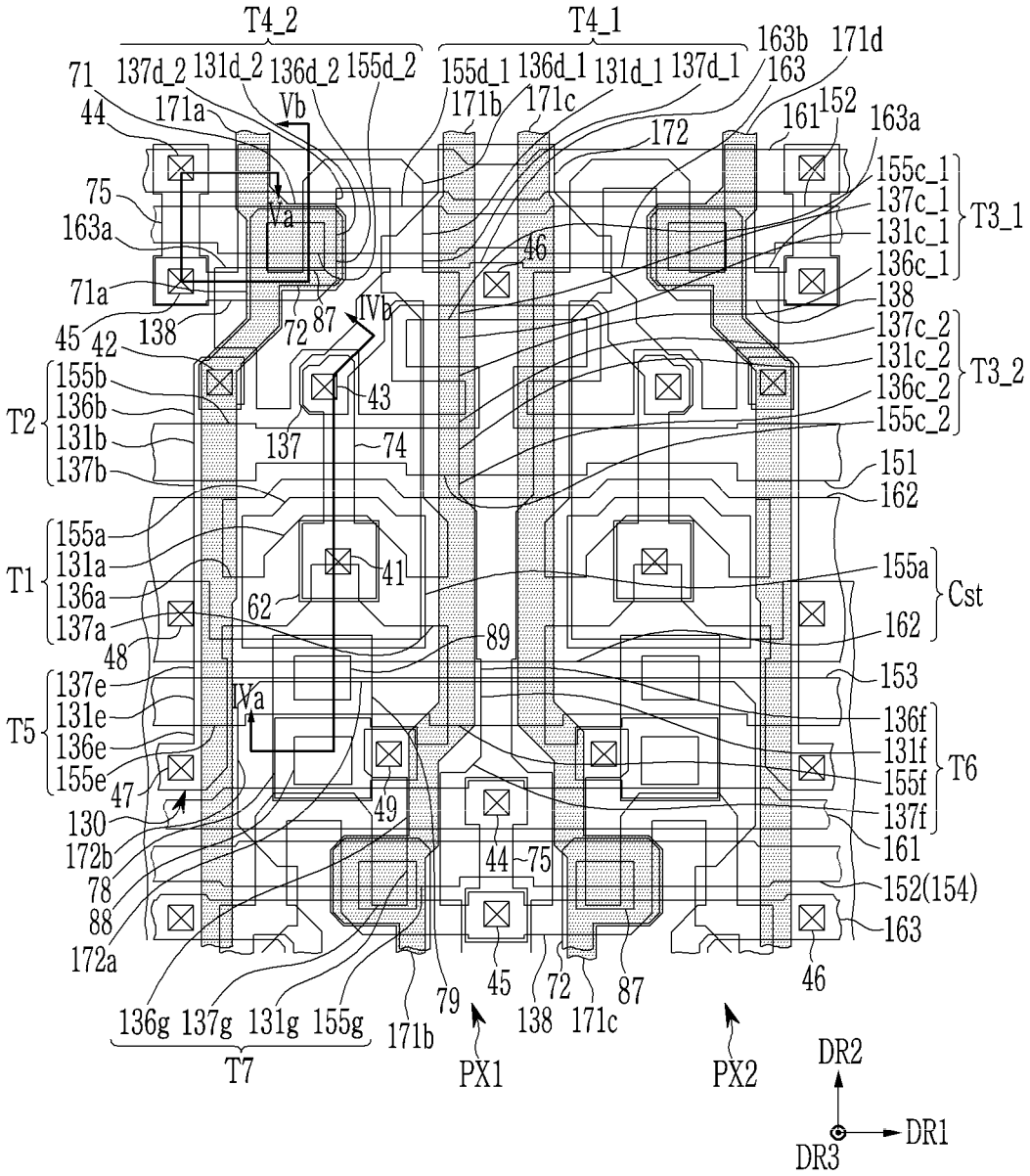
FIG. 3 is a layout view of an exemplary embodiment of a part of a display area of a display device constructed according to principles of the invention.
Figure 5:
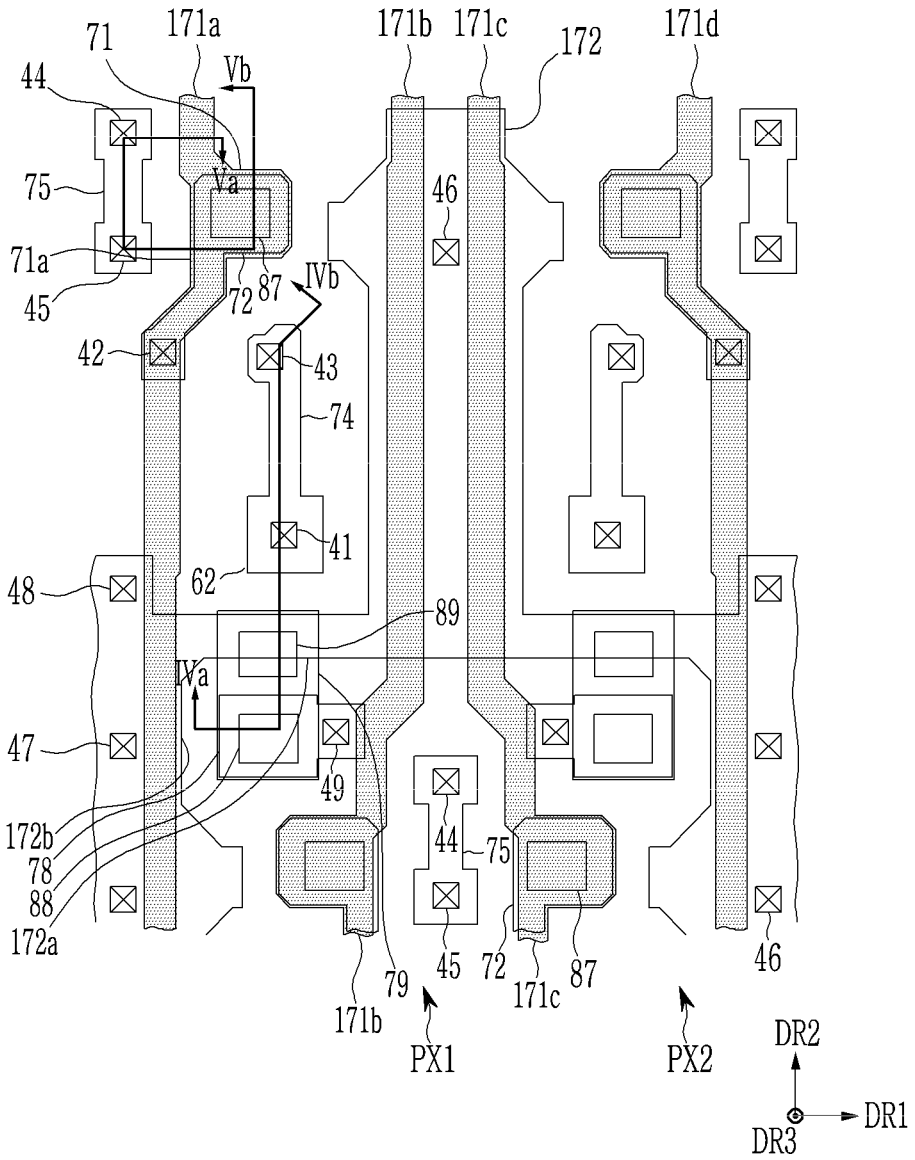
Figure 6:
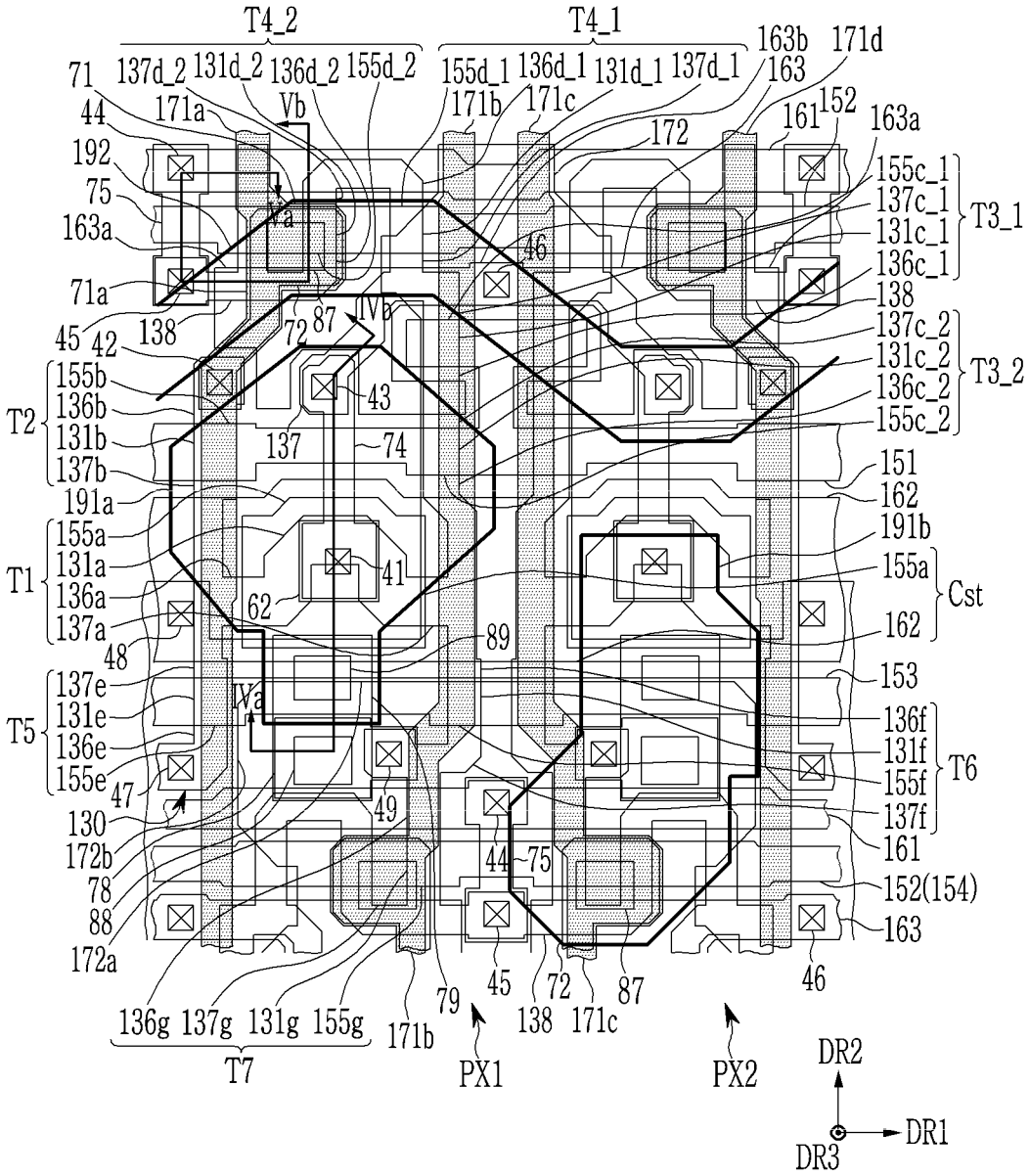
FIG. 6 is a layout view of the display device of FIG. 3, in which a pixel electrode layer is additionally shown.
Figure 7:
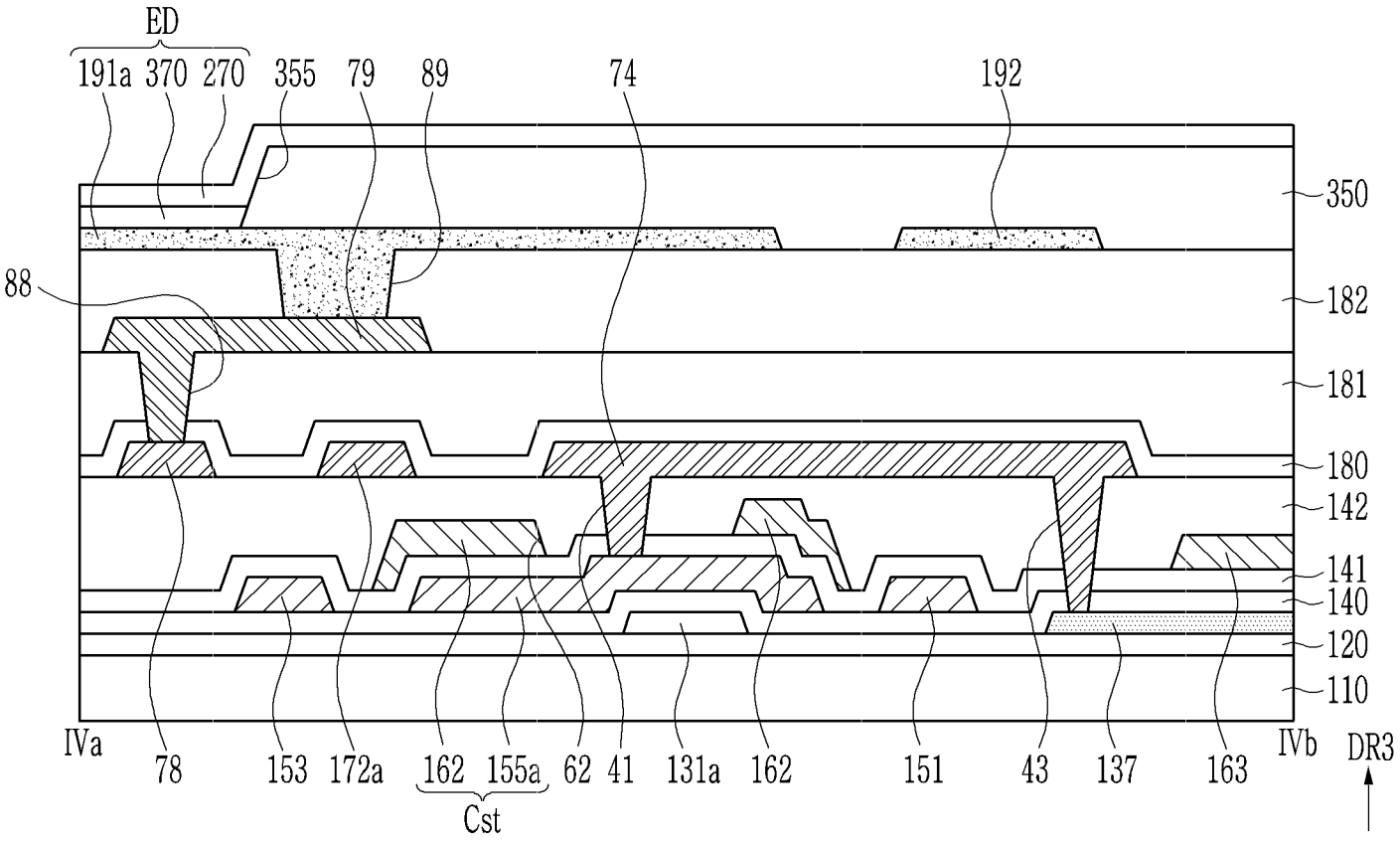
FIG. 7 is a cross-sectional view of the display device of FIG. 3 to FIG. 5, taken along the line IVa-IVb.
Figure 8:
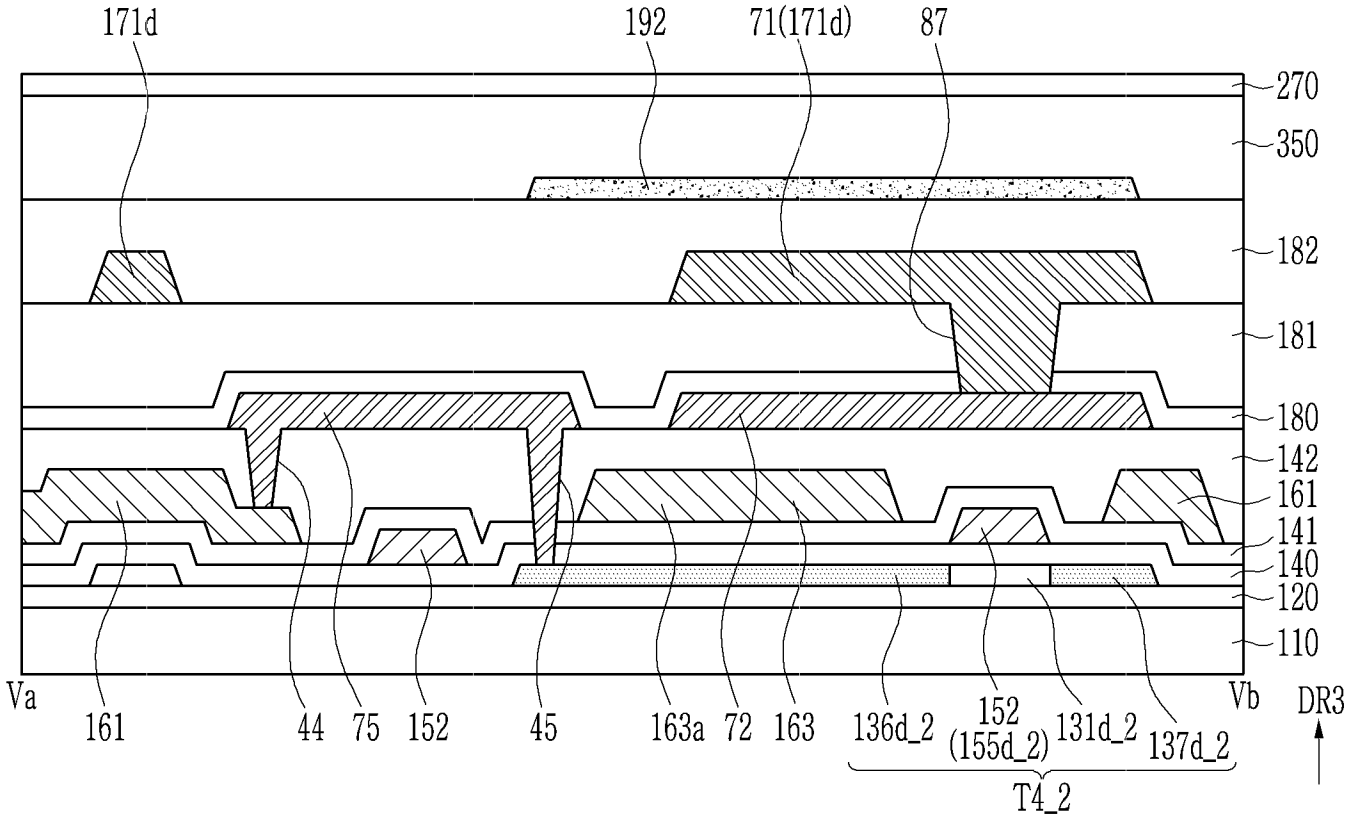
FIG. 8 is a cross-sectional view of the display device of FIG. 3 to FIG. 5, taken along the line Va-Vb.

FIG. 3 to FIG. 6 show a structure of two adjacent pixels PX1 and PX2 in a planar structure. FIG. 3 is a layout view of an exemplary embodiment of a part of a display area of a display device constructed according to principles of the invention. Further, FIG. 7 is a cross-sectional view of the display device of FIG. 3 to FIG. 5, taken along the line IVa-IVb and FIG. 8 is a cross-sectional view of the display device of FIG. 3 to FIG. 5, taken along the line Va-Vb. Referring to FIG. 3, a pixel (PX1 or PX2) of a display device according to an exemplary embodiment may include a plurality of transistors T1, T2, T3_1, T3_2, T4_1, T4_2, T5, T6, and T7 that are connected with a plurality of scan lines 151 and 152 (or 154), a data line 171, and a driving voltage line 172, and a capacitor Cst. The structure shown in FIG. 3 may be iteratively disposed in a first direction DR1 and a second direction DR2.

The structures of two neighboring pixels PX1 and PX2 may be symmetrical to each other in the first direction DR1 (i.e., horizontally symmetrical to each other) as shown in FIG. 3. In addition, for example, two pixels adjacent to each other in the second direction DR1 may be horizontally inverted.

Referring to FIGS. 7 and 8, the display device according to the illustrated exemplary embodiment may include a substrate 110 that may include an inorganic insulation material such as glass, or an organic insulation material such as a plastic like polyimide (PI).

A buffer layer 120, which is an insulation layer, may be disposed on a substrate 110, and an active pattern shown at 130 in FIG. 3, and as channel regions 131*a* in FIG. 7, and 131*d*_2 in FIG. 8 of the active pattern may be disposed on the buffer layer 120. The active pattern 130 may be bent in various shapes as shown in FIG. 3. An active pattern 130 disposed in one pixel (PX1 or PX2) may form one continuum.

The active pattern 130 may include a plurality of channel regions and a plurality of conductive regions having a semiconductor property. The channel regions may include channel regions 131*a*, 131*b*, 131*c*_1, 131*c*_2, 131*d*_1, 131*d*_2, 131*e*, 131*f*, and 131*g* that respectively form channels of the transistors T1, T2, T3_1, T3_2, T4_1, T4_2, T5, T6, and T7, and conductive regions that are disposed at opposite sides of each of the channel regions 131*a*, 131*b*, 131*c*_1, 131*c*_2, 131*d*_1, 131*d*_2, 131*e*, 131*f*, and 131*g* may be a source region and a drain region of the corresponding transistor among T1, T2, T3_1, T3_2, T4_1, T4_2, T5, T6, and T7.

The active pattern 130 may include a semiconductor material such as amorphous silicon, polysilicon, or an oxide semiconductor.

A first insulation layer 140 is disposed on the active pattern 130.

A first conductive layer that includes the plurality of scan lines 151 and 152 (or 154), the control line 153, and a driving gate electrode 155*a* may be disposed on the first insulation layer 140.

The plurality of scan lines 151 and 152 and the control line 153 may respectively extend substantially in the first direction DR1. The first scan line 151 may include a gate electrode 155*c*_1 that protrudes upwardly near a boundary between the two adjacent pixels PX1 and PX2, and thus may be formed in the shape of a letter T.

In substantially the same manner as the second scan line 152 of the illustrated exemplary embodiment, the third scan line 154 shown in the above-described FIG. 2 transmits a scan signal of a next stage of a scan signal transmitted by the second scan line 152, and is shown in a lower side of the two adjacent pixels PX1 and PX2 in FIG. 3 to FIG. 6.

The driving gate electrode 155*a* may be disposed in each of the pixels PX1 and PX2, and may be disposed between the first scan line 151 and the control line 153 in a plan view.

A second insulation layer 141 is disposed on the first conductive layer second 140, and a second conductive layer that includes an initialization voltage line 161, a storage line 162, and a conductive pattern 163 may be disposed on the second insulation layer 141. The initialization voltage line 161 and the storage line 162 may be included in the above-described plurality of signal lines.

The initialization voltage line 161 and the storage line 162 may extend substantially in the first direction DR1.

The initialization voltage line 161 may transmit an initialization voltage Vint.

Referring to FIG. 7, the storage line 162 may overlap most of the driving gate electrode 155*a* in each of the pixels PX1 and PX2, and may include openings 62 that are disposed corresponding to the respective pixels PX1 and PX2. Each opening 62 may vertically overlap the driving gate electrode 155*a*.

The conductive pattern 163 may be disposed between the initialization voltage line 161 and the storage line 162 in a plan view, and the conductive patterns 163 disposed in each of the two adjacent pixels PX1 and PX2 are connected with each other at a boundary of the two pixels PX1 and PX2, thereby forming one continuum corresponding to the two pixels PX1 and PX2.

The storage line 162 and the conductive pattern 163 may transmit the driving voltage ELVDD.

A channel of each of the plurality of transistors T1, T2, T3_1, T3_2, T4_1, T4_2, T5, T6, and T7 may be formed in one active pattern 130.

The first transistor T1 includes the channel region 131*a* of the active pattern 130, source and drain regions 136*a* and 137*a* that are disposed at opposite sides of the channel region 131*a*, and the driving gate electrode 155*a* that overlaps the channel region 131*a* on a plane. The channel region 131*a* may be bent at least once. For example, the channel region 131*a* may have a meandering shape or a zigzag shape, and may include a vertically inverted U shape as shown in FIG. 3 to FIG. 6.

The second transistor T2 includes the channel region 131*b*, source and drain regions 136*b* and 137*b* that are disposed at opposite sides of the channel region 131*b*, and a gate electrode 155*b*, which is a part of the first scan line 151 that overlaps the channel region 131*b* on a plane. The drain region 137*b* is connected with the source region 136*a* of the first transistor T1.

The third transistor T3 may be formed of two portions for prevention of current leakage. That is, the third transistor T3 may include a first portion T3-1 and a second portion T3-2, which are connected with each other.

The first portion T3_1 of the third transistor T3 includes the channel region 131*c*_1, source region and drain regions 136*c*_1 and 137*c*_1 that are disposed at opposite sides of the channel region 131*c*_1, and the gate electrode 155*c*_1, which is a protrusion of the first scan line 151 overlapping the channel region 131*c*_1.

The second portion T3_2 of the third transistor T3 includes the channel region 131*c*_2, source and drain regions 136*c*_2 and 137*c*_2 that are disposed at opposite sides of the channel region 131*c*_2, and a gate electrode 155*c*_2, which is a part of the first scan line 151 overlapping the channel region 131*c*_2. The source region 136*c*_2 of the second portion T3-2 of the third transistor T3 is connected with the drain region 137*a* of the first transistor T1, and the drain region 137*c*_2 is connected with the source region 136*c*_1 of the first portion T3_1 of the third transistor T3.

The fourth transistor T4 may be formed of two portions for prevention of a current leakage. That is, the fourth transistor T4 may include a first portion T4_1 and a second portion T4_2 that are connected with each other.

The first portion T4_1 of the fourth transistor T4 includes the channel region 131*d*_1, source and drain regions 136*d*_1 and 137*d*_1 that are disposed at opposite sides of the channel region 131*d*_1, and a gate electrode 155*d*_1, which is a part of the second scan line 152 overlapping the channel region 131*d*_1. The drain region 137*d*_1 is connected with the drain region 137*c*_1 of the first portion T3_1 of the third transistor T3_1. The conductive region of the active pattern 130 may further include an extension portion 137 that extends from a point where the drain region 137*d*_1 of the first portion T4_1 of the third transistor T4 and the drain region 137*c*_1 of the first portion T3_1 of the third transistor T3 meet.

The second portion T4-2 of the fourth transistor T4_2 includes the channel region 131*d*_2, source and drain regions 136*d*_2 and 137*d*_2 that are disposed at opposite sides of the channel region 131*d*_2, and a gate electrode 155*d*_2, which is a part of the second scan line 152 overlapping the channel region 131*d*_2. The drain region 137*d*_2 is connected with the source region 136*d*_1 of the first portion T4_1 of the fourth transistor T4_1.

The fifth transistor T5 includes the channel region 131*e*, source and drain regions 136*e* and 137*e* that are disposed at opposite sides of the channel region 131*e*, and a gate electrode 155*e*, which is a part of the control line 153 overlapping the channel region 131*e*. The drain region 137*e* is connected with the source region 136*a* of the first transistor T1.

The sixth transistor T6 includes the channel region 131*f*, source and drain regions 136*f* and 137*f* that are disposed at opposite sides of the channel region 13 if, and a gate electrode 155*f*, which is a part of the control line 153 overlapping the channel region 131*f*. The source region 136*f* is connected with the drain region 137*a* of the first transistor T1.

The seventh transistor T7 includes the channel region 131*g*, source and drain regions 136*g* and 137*g* that are disposed at opposite sides of the channel region 131*g*, and a gate electrode 155*g*, which is a part of a scan line (152 or 154 in the lower side of the two adjacent pixels PX1 and PX2 in FIG. 3) overlapping the channel region 131*g*.

The conductive region of the active pattern 130 may further include an extension portion 138 extended from the source region 136*d*_2 of the second portion T4_2 of the fourth transistor T4. The extension portion 138 may extend substantially in the first direction DR1.

The driving gate electrode 155*a* and the storage line 162 overlapping each other in a plan view may form the capacitor Cst that can maintain a voltage of the driving gate electrode 155*a*. The second insulation layer 141 disposed between the driving gate electrode 155*a* and the storage line 162 may function as a dielectric material of the capacitor Cst.

A third insulation layer 142 may be disposed on the second conductive layer.

The first insulation layer 140, the second insulation layer 141, and the third insulation layer 142 may include a plurality of contact holes 42, 43, 45, 47, and 49 that are disposed on the conductive region of the active pattern 130, the second insulation layer 141 and the third insulation layer 142 may include a contact hole 41 disposed on the first conductive layer, and the third insulation layer 142 may include a plurality of contact holes 44, 46, and 48 that are disposed on the second conductive layer.

The first insulation layer 140, the second insulation layer 141, and the third insulation layer 142 may include an inorganic insulation layer such as a silicon nitride (SiNx), a silicon oxide (SiOx), a silicon oxynitride (SiON), and the like, and/or an organic insulation material.

Figure 4:
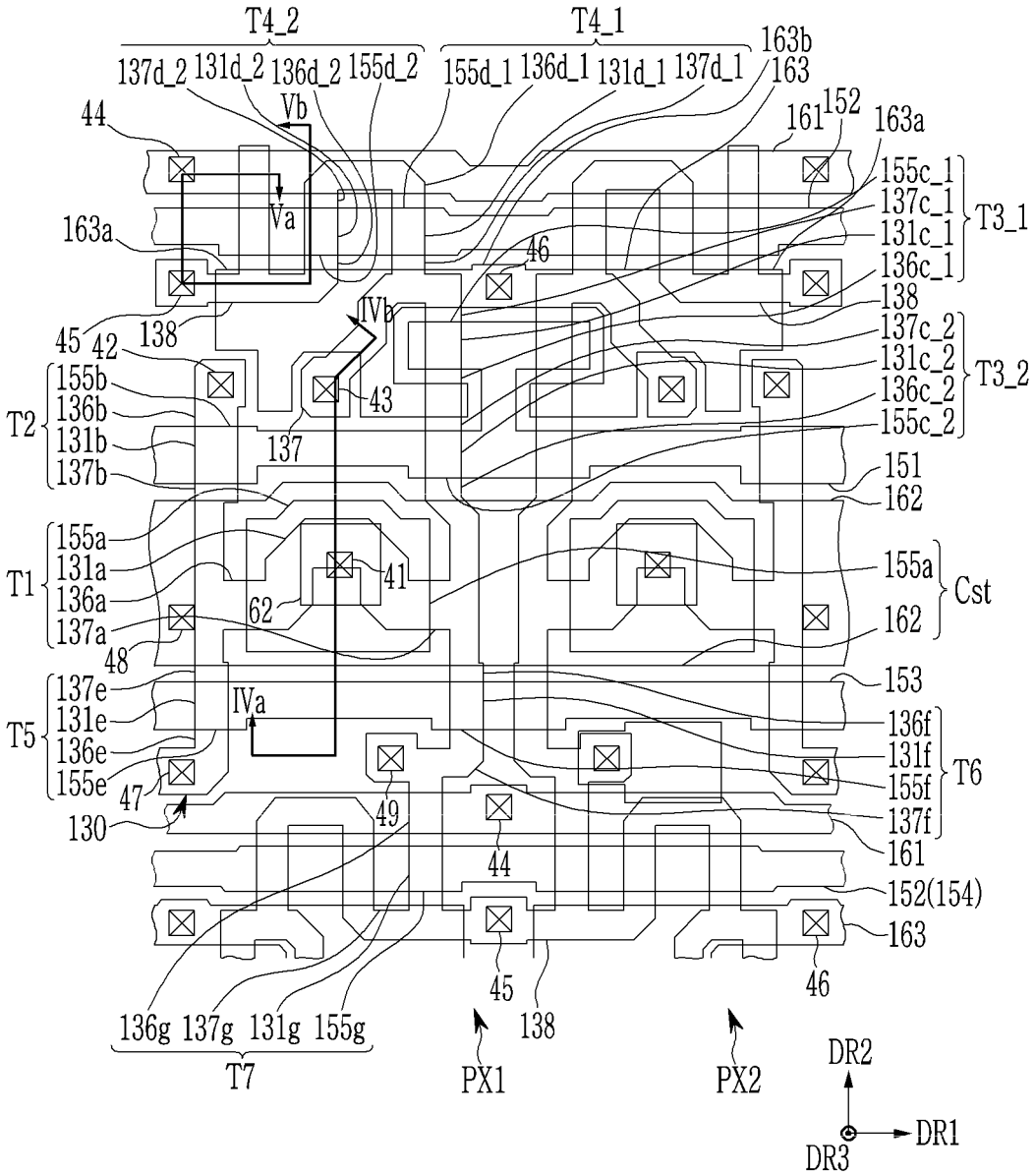
FIG. 4 and FIG. 5 are enlarged layout views of a part of the constituent elements shown in FIG. 3.

FIG. 4 shows only constituent elements which have been described among constituent elements shown in FIG. 3. FIG. 5 shows constituent elements which will be described later, among the constituent elements shown in FIG. 3. In other words, FIG. 4 shows the elements formed between the substrate 110 and the third insulation layer 142, and FIG. 5 shows the elements formed on the third insulation layer 142.

A third conductive layer that includes the driving voltage line 172, and a plurality of connection members 74, 75, and 78 may be disposed on the third insulation layer 142.

The driving voltage line 172 may transmit the driving voltage ELVDD, and may receive the driving voltage ELVDD through a pad portion of the display device. The driving voltage line 172 may include a portion extending substantially in the second direction DR2, while overlapping a boundary between the two adjacent pixels PX1 and PX2 which are symmetrical to each other, a horizontal portion 172*a* disposed in each of the pixels PX1 and PX2 and extending substantially in the first direction DR1, and an expansion portion 172*b* connected to an end portion of each horizontal portion 172*a*.

The driving voltage line 172 may be electrically connected with a portion 163*b* that is disposed at a boundary between the two adjacent pixels PX1 and PX2 in the conductive pattern 163 through the contact hole 46. The expansion portion 172*b* of the driving voltage line 172 may be electrically connected with the source region 136*e* of the fifth transistor T5, and may be connected with the storage line 162 through the contact hole 48. Thus, the source region 136*e* of the fifth transistor T5 and the storage line 162 may receive the driving voltage ELVDD by being electrically connected with the driving voltage line 172.

A first connection member 72 may be electrically connected with the source region 136*b* of the second transistor T2 through the contact hole 42. The first connection member 72 may include a portion that extends in a direction oblique to the first direction DR1 and the second direction DR2.

The second connection member 74 extends substantially in the second direction DR2 and thus may cross the first scan line 151. One end portion of the second connection member 74 may be electrically connected with the driving gate electrode 155*a* through the contact hole 41. The contact hole 42 is disposed in the opening 62 of the storage line 162. The other end portion of the second connection member 74 may be electrically connected with the extension portion 137 of the active pattern 130, and connected with the drain region 137*d*_1 of the first portion T4_1 of the fourth transistor T4 and the drain region 137*c*_1 of the first portion T3_1 of the third transistor T3. Thus, the drain region 137*d*_1 of the first portion T4_1 of the fourth transistor T4 and the drain region 137*c*_1 of the first portion T3_1 of the third transistor T3 may be electrically connected with the driving gate electrode 155*a* through the second connection member 74. The second connection member 74 corresponds to the driving gate node GN shown in the circuit diagram of FIG. 2, together with the driving gate electrode 155*a*.

The third connection member 75 may extend substantially in the second direction DR2. One end portion of the third connection member 75 may be electrically connected with the initialization voltage line 161 through the contact hole 44, and the other end portion thereof may be electrically connected with a part (referred to as a first conductive region) of the extension portion 138 of the active pattern 130, connected with the drain region 137*g* of the seventh transistor T7 through the contact hole 45. Thus, the drain region 137*g* of the seventh transistor T7 may receive the initialization voltage Vint by being electrically connected with the initialization voltage line 161.

The fourth connection member 78 may be electrically connected with the drain region 137*f* of the sixth transistor T6 through the contact hole 49.

A fourth insulation layer 180 and a fifth insulation layer 181 may be disposed on the third conductive layer. The fourth insulation layer 180 and the fifth insulation layer 181 may include a contact hole 87 disposed on the first connection member 72 and a contact hole 88 disposed on the fourth connection member 78.

The fourth insulation layer 180 may include an inorganic insulating material and/or an organic insulating material, and the fifth insulation layer 181 may include an organic insulating material such as a polyimide, an acryl-based polymer, a siloxane-based polymer, and the like. The fourth insulation layer 180 may be omitted.

A fourth conductive layer that includes a plurality of data lines 171*a*, 171*b*, 171*c*, and 171*d* and a fifth connection member 79 may be disposed on the fifth insulation layer 181.

The data lines 171*a*, 171*b*, 171*c*, and 171*d* are the previously described data lines 171, and may extend substantially in the second direction DR2 in a plan view and thus may cross the scan lines 151 and 152 and the control line 153. The plurality of data lines 171*a* and 171*b* and the plurality of data lines 171*c* and 171*d* may be disposed corresponding to each other in the respective pixels PX1 and PX2. For example, as shown in FIG. 3, FIG. 5, and FIG. 6, a pair of first data line 171*a* and second data line 171*b* may be disposed in the first pixel PX1 and a pair of third data line 171*c* and fourth data line 171*d* may be disposed in the second pixel PX2. The shape of the first data line 171*a* and the shape of the fourth data line 171*d* may be bilaterally symmetrical to each other with reference to the boundary of the two adjacent pixels PX1 and PX2, and the shape of the second data line 171*b* and the shape of the third data line 171*c* may be symmetrical to each other.

Each of the first and fourth data lines 171*a* and 171*d* may include expansion portions 71 overlapping the first connection member 72. The expansion portion 71 may be electrically connected with the first connection member 72 through the contact hole 87. Thus, the source region 136*b* of the second transistor T2 may receive a data signal Dm through the first connection member 72 by being electrically connected with the first and fourth data lines 171*a* and 171*d*.

The fifth connection member 79 may be electrically connected with the fourth connection member 78 of the third conductive layer through the contact hole 88. In a plan view, the fifth connection member 79 may be disposed between a pair of data lines 171*a* and 171*b* and between the pair of data lines 171*c* and 171*d*, corresponding to the respective pixels PX1 and PX2.

At least one of the first conductive layer, the second conductive layer, the third conductive layer, and the fourth conductive layer may include a conductive material such as copper (Cu), aluminum (Al), molybdenum (Mo), titanium (Ti), tantalum (Ta), and an alloy of at least two of them.

A sixth insulation layer 182 may be disposed on the fourth conductive layer. The sixth insulation layer 182 may include a contact hole 89 disposed on the fifth connection member 79. The sixth insulation layer 182 may include an organic insulation layer such as a polyacryl-based resin, a polyimide-based resin, and the like, and a top surface thereof may be substantially flat.

Referring to FIG. 6 to FIG. 9, a pixel electrode layer that includes a plurality of pixel electrodes 191*a*, 191*b*, and 191*c* and a plurality of voltage lines 192 may be disposed on the sixth insulation layer 182.

Figure 9:
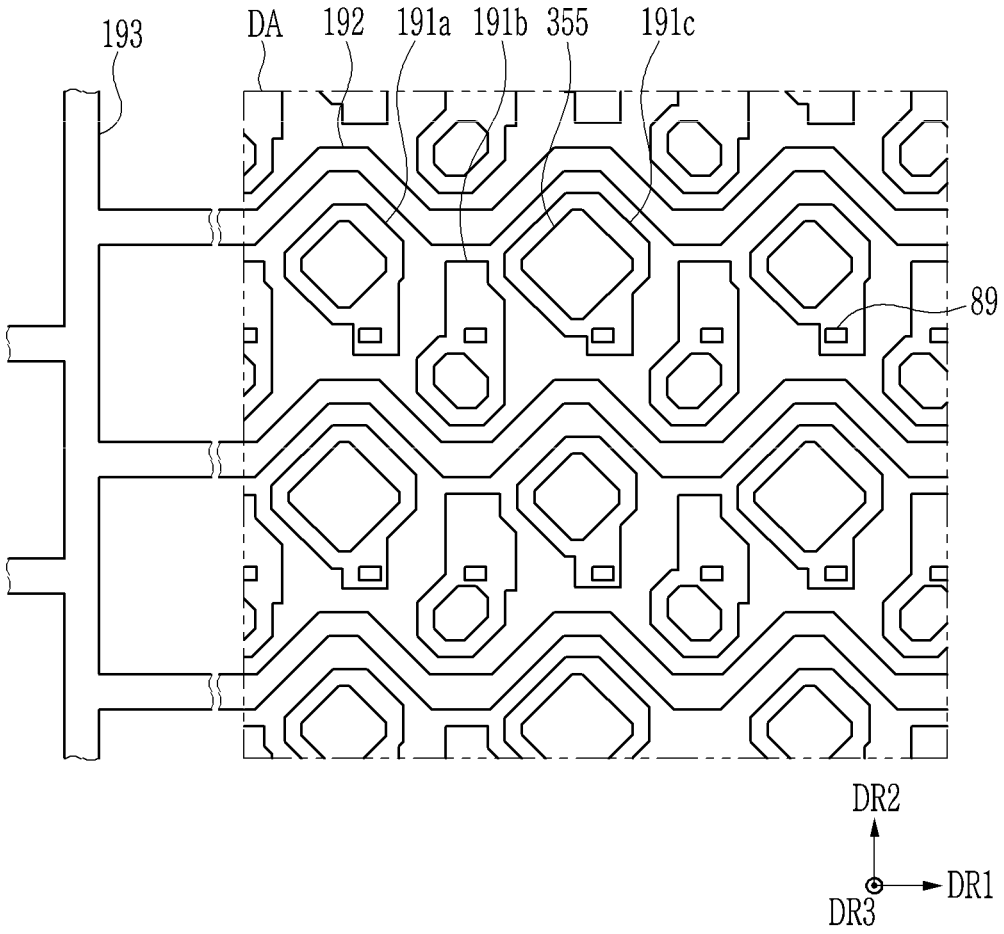
FIG. 9 is a layout view of the pixel electrode layer of a display device according to an exemplary embodiment.

Referring to FIG. 9, each of the pixel electrodes 191*a*, 191*b*, and 191*c* may correspond to each of the corresponding pixels. Each of the pixel electrodes 191*a*, 191*b*, and 191*c* is connected with the fifth connection member 79 and the fourth connection member 78 through the contact hole 89 in the each of the corresponding pixels, and thus may receive a voltage by being electrically connected with the drain region 137*f* of the sixth transistor T6.

Referring to FIG. 6 and FIG. 9, the plurality of pixel electrodes 191*a*, 191*b*, and 191*c* may be disposed in a display area DA, which is an area where an image can be displayed in the display device. The plurality of pixel electrodes 191*a*, 191*b*, and 191*c* may be arranged in a format of a pentile matrix. For example, the first pixel electrode 191*a* and the third pixel electrode 191*c* may be alternately arranged in the first direction DR1, the first pixel electrode 191*a* and the second pixel electrode 191*b* may be alternately arranged in an diagonal direction that is inclined with respect to the first direction DR1 and the second direction DR2, and the third pixel electrode 191*c* and the second pixel electrode 191*b* may be alternately arranged in another diagonal direction. The first pixel electrode 191*a* may be smaller than the third pixel electrode 191*c*, and the second pixel electrode 191*b* may be smaller than the first pixel electrode 191*a*. However, the alignment and the shape of the first to third pixel electrodes 191*a*, 191*b*, and 191*c* are not limited thereto.

Each of the voltage lines 192 extends substantially in the first direction DR1, and may be curved along edges of the pixel electrodes 191*a*, 191*b*, and 191*c*. The voltage lines 192 may cross the plurality of data lines 171*a*, 171*b*, 171*c*, and 171*d*. The plurality of voltage lines 192 are arranged substantially in the second direction DR2 and extend to an outer area of the display area DA and thus may be connected to one wire 193, and may receive a constant voltage such as a driving voltage ELVDD or a common voltage ELVSS through the wire 193. The wire 193 may be disposed in the pixel electrode layer or may be disposed in another conductive layer.

The voltage lines 192 may overlap at least a part of the channel region 131*c*_1 of the first portion T3_1 of the third transistor T3, and overlap at least a part of the channel region 131*d*-1 of the first portion T4_1 of the fourth transistor T4. Thus, external light can be blocked to from entering the channel region 131*c*_1 of the first portion T3_1 of the third transistor T3 and the channel region 131*d*_1 of the first portion T4_1 of the fourth transistor T4, which are directly connected with the driving gate electrode 155*a*, and accordingly, occurrence of a leakage current can be prevented, and a voltage change of the driving gate electrode 155*a* due to external light can be prevented, thereby preventing a display failure such as luminance change and color coordination variation of an image.

The pixel electrode layer may include a semi-transmissive conductive material or a reflective conductive material.

A seventh insulation layer 350 may be disposed on the pixel electrode layer. The seventh insulation layer 350 may also be referred to as a pixel defining layer PDL. The seventh insulation layer 350 may have openings 355 disposed on the respective pixel electrodes 191*a*, 191*b*, and 191*c*.

An emission layer 370 is disposed on the pixel electrodes 191*a*, 191*b*, and 191*c*. The emission layer 370 includes a portion that is disposed in the opening 355 of the seventh insulation layer 350, and may further include a portion disposed on a top surface of the seventh insulation layer 350. The emission layer 370 may include an organic light emission material or an inorganic light emission material.

A common electrode 270 is disposed on the emission layer 370. The common electrode 270 is also disposed on the seventh insulation layer 350, and thus may extend over the plurality of pixels PX1 and PX2. The common electrode 270 may transmit a common voltage ELVSS.

The pixel electrodes 191*a*, 191*b*, and 191*c*, the emission layer 370, and the common electrode 270 form a light emitting diode ED.

For example, a light emitting diode ED including the pixel electrode 191*a* may emit light of red, a light emitting diode ED including the pixel electrode 191*b* may emit light of green, and a light emitting diode ED including the pixel electrode 191*c* may emit light of blue.

A sealing layer may be further disposed on the common electrode 270 to protect the light emitting diodes ED. The sealing layer may include inorganic layers and organic layers that are alternately stacked.

According to the illustrated exemplary embodiment, a bent portion 71*a* is formed by bending the first data line 171*a* and the fourth data line 171*d* in a direction away from the third connection member 75 which receives the initialization voltage Vint, at the periphery of the third connection member 75 such that the first and fourth data lines 171*a* and 171*d* that are disposed close to the third connection member 75 can be separated from the third connection member 75 in a plan view. In detail, the first data line 171*a* that corresponds to the first pixel PX1 be projected, more specifically bent, to the right so as to be sufficiently separated from the third connection member 75 disposed at the left side such that the bent portion 71*a* (or projecting portion) can be formed, and the fourth data line 171*d* that corresponds to the second pixel PX2 is projected, more specifically bent, to the left so as to be sufficiently separated from the third connection member 75 disposed at the right side such that the bent portion 71*a* can be formed. On the contrary, the second data line 171*b* and third data line 171*c* that are disposed closer to the boundary of the two pixels PX1 and PX2, while neighboring with the first and fourth data lines 171*a* and 171*d* in the first direction DR1, may extend substantially straight at the periphery of the initialization voltage line 161 and the second scan line 152.

The data lines 171*a*, 171*b*, 171*c*, and 171*d* may be separated further away from the third connection member 75, which receives the initialization voltage Vint, by locating the data lines 171*a*, 171*b*, 171*c*, and 171*d* in a fourth conductive layer, which is different from the third conductive layer where the third connection member 75 is located.

Since the initialization voltage line 161 is disposed in the second conductive layer and the data lines 171*a*, 171*b*, 171*c*, and 171*d* are disposed in the fourth conductive layer, a distance on the cross-section between the initialization voltage line 161 and the data lines 171*a*, 171*b*, 171*c*, and 171*d* that overlap each other in a plan view by crossing each other may be increased.

The active pattern 130 (e.g., the source region 136*g* of the seventh transistor T7) (in case of the data lines 171*a* and 171*d*) or the driving voltage line 172 (in case of the data lines 171*b* and 171*c*) is disposed between the initialization voltage line 161 and the data lines 171*a*, 171*b*, 171*c*, and 171*d* that overlap each other, and thus direct generation of a parasitic capacitor and direct coupling between signals between the initialization voltage line 161 and the data lines 171*a*, 171*b*, 171*c*, and 171*d* can be prevented.

The first data line 171*a* disposed close to the third connection member 75 may affect the initialization voltage Vint (this is called coupling between a data signal and an initialization voltage) transmitted by the initialization voltage line 161 when a data voltage is charged in the first data line 171*a* or the voltage of the first data line 171*a* is changed, or a ripple may occur in the initialization voltage Vint due to the parasitic capacitor between the first data line 171*a* and the third connection member 75. The changed (i.e., rippled) initialization voltage Vint transmitted by the initialization voltage line 161 may cause a data voltage charged in a fourth data line 171*d* that is adjacent to a third connection member 75 corresponding to the neighboring second pixel PX2 to be changed through the third connection member 75, thereby causing a display failure such as the plurality of first voltage lines extending to an outer area of the display area and thus connected with a wire that transmits the driving voltage.

However, according to the illustrated exemplary embodiment, the data lines 171*a* and 171*d* form the bent portion 71*a* by being bent to be away from the third connection member 75 that delivers the initialization voltage Vint, and they are disposed on a conductive layer that is different from a layer where the third connection member 75 is formed in a cross-sectional view such that capacitance of the parasitic capacitor between the data lines 171*a* and 171*d* and the third connection member 75 can be reduced and coupling between the initialization voltage Vint and the data signal can be prevented, thereby preventing a display failure such as horizontal line stains.

The above-described conductive pattern 163 may include a shield portion 163*a* that is disposed between the third connection member 75, which delivers the initialization voltage Vint, and the first and fourth data lines 171*a* and 171*d* in a plan view. The shield portion 163*a* overlaps a portion (referred to as a second conductive region) of the extension portion 138 of the active pattern 130, which is disposed between the third connection member 75 and the first and fourth data lines 171*a* and 171*d* on a plane, is electrically connected with the third connection member 75 to shield between the data lines 171*a* and 171*d* and the extension portion 138 of the active pattern 130. Thus, coupling between the data signal delivered by the first and fourth data lines 171*a* and 171*d* and the initialization voltage Vint can be further prevented.

When a constant voltage, for example, the driving voltage ELVDD or the common voltage ELVSS, which is different from the initialization voltage Vint, is applied to the voltage line 192 disposed in the pixel electrode layer, coupling between the data signal and the initialization voltage Vint due to overlapping between the voltage line 192, which crosses the data lines 171*a*, 171*b*, 171*c*, and 171*d*, and the data lines 171*a*, 171*b*, 171*c*, and 171*d*, can be further reduced.

Next, a display device and a driving method thereof according to an exemplary embodiment will be described with reference to FIG. 10 and FIG. 11, together with the above-described drawings.

Figure 10:
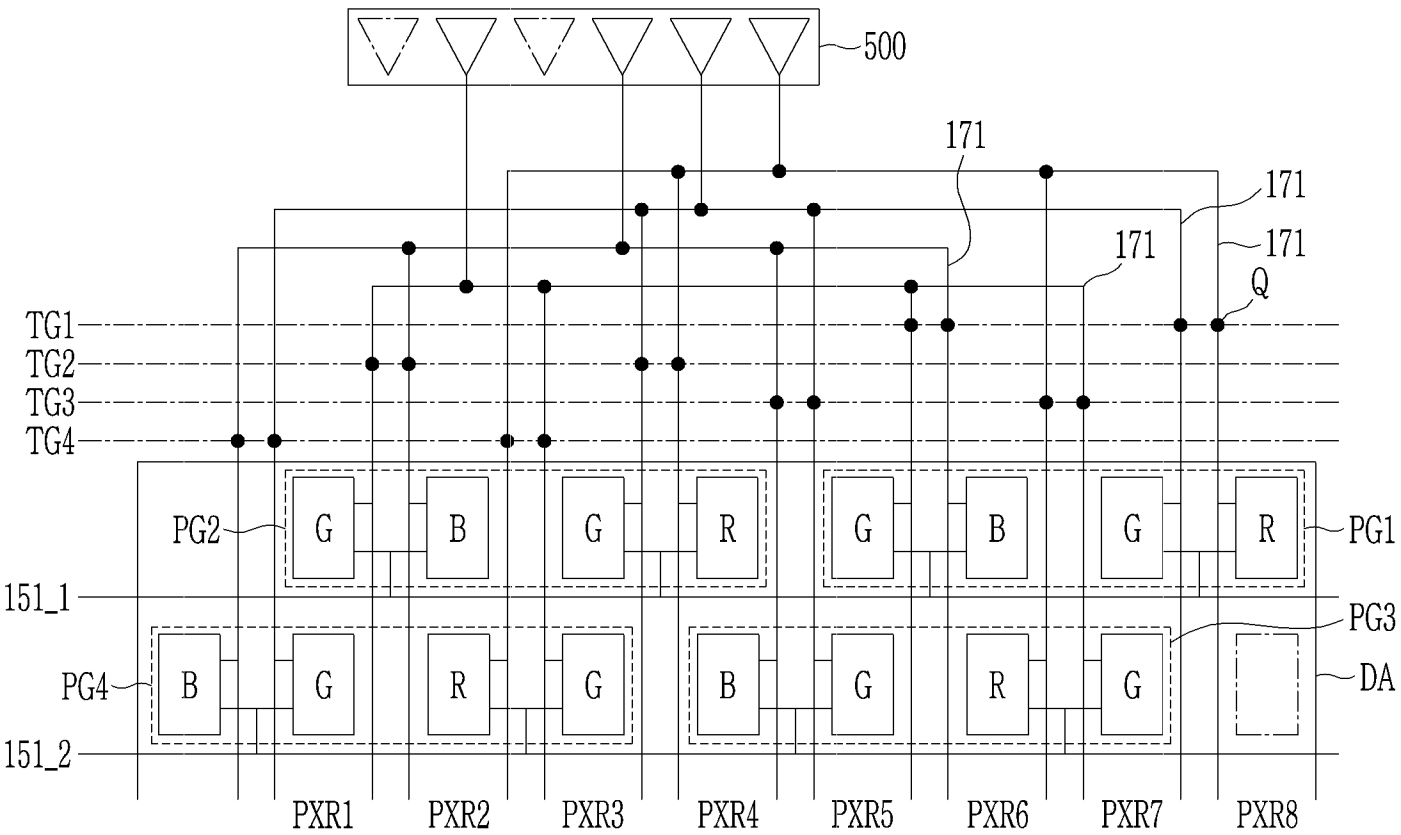
FIG. 10 shows a circuit connected with a data line of a display device according to an exemplary embodiment.

Referring to FIG. 10, a display device according to exemplary embodiment may further include a data driver 500 that applies a data signal Dm. The data driver 500 is connected with a plurality of data lines 171 and thus may output the data signal Dm.

A display area DA may include a plurality of pixels R, G, and B, the plurality of data lines 171, and a plurality of scan lines 151_1 and 151_2. Each of the scan lines 151_1 and 151_2 may be the same as the above-described first scan line 151.

The pixels R, G, and B may be the same as the above-described pixels PX, PX1, and PX2, and R, G, and B respectively represent red R, green G, and blue B, which can be displayed by the respective pixels R, G, and B. Each of the pixels R, G, and B may be connected with a corresponding data line 171 and a corresponding first scan line 15_1 or 151_2. A transistor in each of the pixels R, G, and B connected with the data line 171 and the first scan line 151_1 or 151_2 may be the above-described second transistor T2.

When the plurality of pixels R, G, and B are arranged substantially in a matrix format, a pair of data lines 171 correspondingly disposed in a plurality of pixel arrays PXR1, PXR2, . . . , PXR8 may be connected to pixels R, G, and B of the corresponding pixel arrays PXR1, PXR2, . . . , PXR8. Pixels R, G, and B of each of the pixel arrays PXR1, PXR2, PXR7, and PXR8 may be alternately connected to a pair of data lines 171. A pair of adjacent data lines 171 are disposed between two adjacent pixels of R, G, and B, and the two adjacent pixels of R, G, and B are respectively connected to the data lines 171 disposed therebetween such that the above-described horizontally symmetrical structure can be formed.

A plurality of transmission gate lines TG1, TG2, TG3, and TG4 may be disposed between the data driver 500 and the display area DA. The transmission gate lines TG1, TG2, TG3, and TG4 may transmit a transmission gate signal, and may cross the plurality of data lines 171. The respective data lines 171 are connected with switches Q, each connected with at least one of the transmission gate lines TG1, TG2, TG3, and TG4, and thus when a gate-on voltage Von is applied to the transmission gate lines TG1, TG2, TG3, and TG4, a data signal Dm from the data driver 500 may be applied to the corresponding data line 171.

Figure 11:
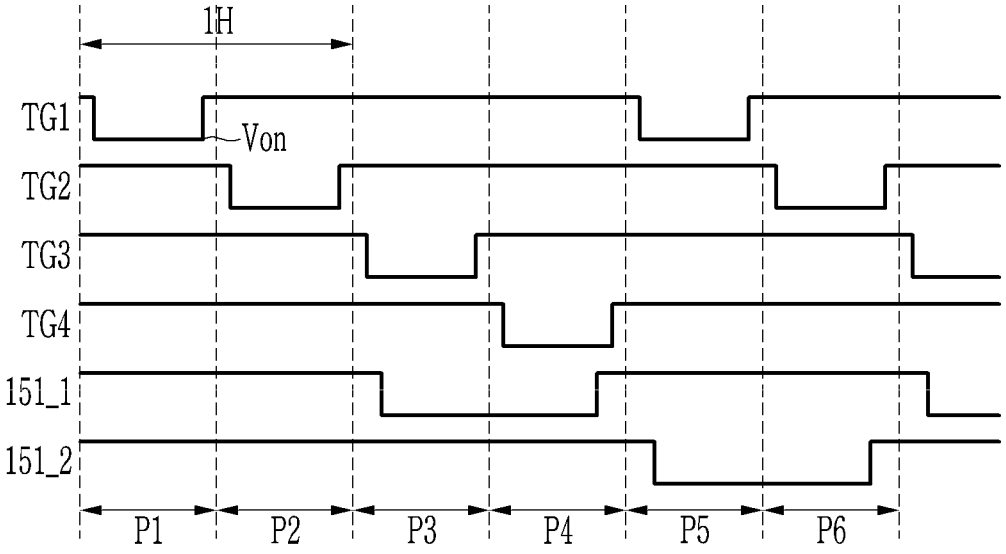
FIG. 11 is a waveform diagram of a driving signal of a display device according to an exemplary embodiment.

Referring to FIG. 11 together with FIG. 10, when the gate-on voltage Von (in this case, a low level) is applied to the transmission gate line TG1 during about half a horizontal period H/2 in a first section P1, a voltage of the data line Dm is charged in data lines 171 that are connected with switches Q, which are connected with the transmission gate line TG1.

Next, in a second section P2, when the gate-on voltage Von is applied to the transmission gate line TG2 during about half a horizontal period H/2, the voltage of the data signal Dm is charged in data lines 171 that are connected with switches Q, which is connected with the transmission gate line TG2. Similarly, the gate-on voltage Von can be sequentially applied to the transmission gate line TG3 and the transmission gate line TG4 in a third section P3 and a fourth section P4.

Next, when the gate-on voltage Von is applied to the first scan line 151_1 during about one horizontal period 1H in the third section P3 and the fourth section P4, pixels R, G, and B of pixel groups PG1 and PG2 connected with data lines 171, which are connected with the transmission gate lines TG1 and TG2 through the switches Q, while being connected with the first scan line 151_1, are applied with voltages that are charged in the corresponding data lines 171.

Next, when the gate-on voltage Von is applied to the first scan line 151_2 during about one horizontal period 1H in a fifth section P5 and a sixth section P6, pixels R, G, and B of pixel groups PG3 and PG4 connected with data lines 171, which are connected with the transmission gate lines TG3 and TG4 through the switches Q, while being connected with the first scan line 151_2, are applied with voltages that are charged in the corresponding data lines 171.

According to such a driving method, since a section during which a data voltage is charged to a data line 171 first and then the data voltage is charged to another data line 171 while the previously charged data line 171 is being floated from the data driver 500, is provided, as previously described, a ripple of the initialization voltage Vin coupled with a data signal of a data line 171 may affect a data voltage of another data line 171, which is in a floated state, thereby causing a display failure such as horizontal line stains. However, the display device according to the exemplary embodiments can prevent such a display failure by preventing coupling between the initialization voltage Vint and the data signal as previously described.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display device comprising:

a substrate;

an active pattern including a semiconductor material disposed on the substrate;

a first conductive layer disposed on the active pattern, the first conductive layer including a plurality of scan lines extending substantially in a first direction and a driving gate electrode;

a second conductive layer disposed on the first conductive layer, the second conductive layer including an initialization voltage line to transmit an initialization voltage;

a third conductive layer disposed on the second conductive layer, the third conductive layer including a driving voltage line to transmit a driving voltage;

a fourth conductive layer disposed on the third conductive layer, the fourth conductive layer including a first data line to transmit a data signal; and a pixel electrode layer disposed on the fourth conductive layer, the pixel electrode layer including a plurality of pixel electrodes, wherein the third conductive layer comprises a connection member electrically connected with the initialization voltage line, the first data line comprises a first portion extending substantially in a second direction intersecting the first direction, and a second portion that is closer to the connection member than the first portion, and the second portion is curved from the first portion in a direction away from the connection member and extends across the second direction.

2. The display device of claim 1, further comprising:

a first insulation layer disposed between the active pattern and the first conductive layer;

a second insulation layer disposed between the first conductive layer and the second conductive layer;

a third insulation layer disposed between the second conductive layer and the third conductive layer; and a fourth insulation layer disposed between the third conductive layer and the fourth conductive layer, wherein the third insulation layer has a first contact hole extending through the initialization voltage line, the first insulation layer, the second insulation layer, and the third insulation layer have a second contact hole extending through a first conductive region of the active pattern, and the connection member is electrically connected with the initialization voltage line through the first contact hole, and is electrically connected with the first conductive region of the active pattern through the second contact hole.

3. The display device of claim 2, wherein the connection member comprises a portion that extends substantially in parallel with the first data line.

4. The display device of claim 3, wherein the fourth conductive layer further comprises a second data line that neighbors the first data line in the first direction, a third data line that neighbors the second data line in the first direction, and a fourth data line that neighbors the third data line in the first direction, the fourth data line and the first data line have shapes that are substantially symmetrical to each other in the first direction, and the third data line and the second data line have shapes that are substantially symmetrical to each other in the first direction.

5. The display device of claim 4, wherein the first data line intersects the initialization voltage line, and the active pattern comprises a portion disposed between the first data line and the initialization voltage line.

6. The display device of claim 4, wherein the second data line intersects the initialization voltage line, and the driving voltage line comprises a portion disposed between the second data line and the initialization voltage line.

7. The display device of claim 2, wherein the active pattern further comprises a second conductive region connected with the first conductive region, the second conductive region is disposed between the first data line and the connection member, and the second conductive layer further comprises a conductive pattern that overlaps the second conductive region.

8. The display device of claim 7, wherein the conductive pattern is electrically connected with the driving voltage line.

9. The display device of claim 8, wherein the plurality of scan lines comprises a first scan line and a second scan line, and the conductive pattern is disposed between the first scan line and the second scan line.

10. The display device of claim 1, wherein the pixel electrode layer further comprises a plurality of first voltage lines to transmit the driving voltage, the plurality of first voltage lines are arranged in one direction in a display area where the plurality of pixel electrodes are disposed, and the plurality of first voltage lines extend to an outer area of the display area and are connected with a wire configured to transmit the driving voltage.

11. The display device of claim 10, wherein the plurality of first voltage lines are not electrically coupled with the driving voltage line in the display area.

12. The display device of claim 11, wherein each of the plurality of first voltage lines comprises a bent portion bent along a periphery of the plurality of pixel electrodes.

13. The display device of claim 1, further comprising a common electrode disposed on the plurality of pixel electrodes to receive a common voltage, wherein the pixel electrode layer further comprises a plurality of first voltage lines to transmit the common voltage, the plurality of first voltage lines are arranged in one direction in a display area where the plurality of pixel electrodes are disposed, and the plurality of first voltage lines extend to an outer area of the display area and are connected with a wire to transmit the common voltage.

* * * * *